US005522499A

United States Patent [19]

DeBiasio et al.

[11] Patent Number: 5,522,499

[45] Date of Patent: Jun. 4, 1996

[54] PACKAGE FOR HOLDING A PAIR OF ARTICLES

[75] Inventors: Brian F. DeBiasio, Hamilton; Silvana G. Driscoll, Jackson, both of N.J.

[73] Assignee: Sara Lee Corporation, Winston-Salem, N.C.

[21] Appl. No.: 422,703

[22] Filed: Apr. 12, 1995

[51] Int. Cl.[6] ..... B65D 85/18; B65D 25/54

[52] U.S. Cl. ..... 206/278; 206/461; 206/738; 206/771; 229/87.16

[58] Field of Search ..... 206/45.33, 278, 206/281, 299, 461, 466, 806; 229/87.16

[56] References Cited

U.S. PATENT DOCUMENTS

| | | | |
|---|---|---|---|
| 1,133,522 | 3/1915 | Wordingham | 229/87.16 |
| 2,581,099 | 1/1952 | Guffey | 206/278 |
| 2,732,934 | 1/1956 | Hall | 206/278 |
| 2,757,791 | 8/1956 | Kendig | 206/45.33 |
| 2,968,393 | 1/1961 | Phillips, Jr. | 206/299 |
| 3,003,621 | 10/1961 | King | 206/45.33 |
| 3,099,353 | 7/1963 | Berry | 206/278 |
| 3,104,011 | 7/1963 | Bowman | 206/45.33 |
| 3,844,409 | 10/1974 | Bodoley et al. | 206/466 |
| 4,852,783 | 8/1989 | Bryden et al. | 229/87.16 |

*Primary Examiner*—David T. Fidei

[57] ABSTRACT

A package for holding a pair of articles having a foldable insert with a top portion, bottom portion, a dividing portion connecting the top and bottom portions, and a display flap associated with the bottom portion. A clear shell houses the insert and pair of articles and has a front, two sides, a bottom and a back, the back having flaps moveable from the closed position holding the pair of articles within the shell to an open position permitting the articles to be removed.

21 Claims, 1 Drawing Sheet

PACKAGE FOR HOLDING A PAIR OF ARTICLES

BACKGROUND OF THE INVENTION

1. Field of the Invention

The present invention relates generally to packaging and more particularly to a package for holding a pair of articles that can be hung on a fixture or stacked like regular boxed gloves.

2. Description of the Prior Art

Conventional packaging for paired articles such as gloves, socks, handkerchiefs and the like is usually a rectangular box with a clear top enabling the closed articles to be viewed substantially in their entirety. However, it is sometimes awkward to open the box and remove the articles in order to try them on, and in most cases, they are not replaced properly in the package and thus, the display is adversely affected.

Because there is a need to provide more effective and usable packaging for paired articles, and to enable access to the article for try-on without disrupting or damaging the package, there is an ongoing need to revise traditional paired article packaging. It is to this need that the present invention is directed.

OBJECTIVES AND SUMMARY OF THE INVENTION

It is an objective of the present invention to provide a package for holding a pair of articles that has all and more of the advantages of prior art devices and none of the disadvantages.

Another objective of the present invention is to provide a package of the type described that can be hung on a fixture as well as stacked in a regular fashion.

Yet another objective of the present invention is to provide a package of the type described that will enable easy access to at least one of the paired articles for try-on.

A further objective of the present invention is to provide a package of the type described which carries informational indicia printed directly on the clear shell housing rather than on an insert.

Yet still another further objective of the present invention is to provide a package of the type described which has sufficient space for manufacturer and retailer data directly on the package as well as other traditional information such as company name, trademark, fiber content, care instructions and the like.

The package comprising the present invention includes a foldable insert having a top portion, a bottom portion, a dividing portion connecting the top and bottom portion, and a display flap associated with the bottom portion. A clear shell houses the insert and pair of articles and has a front, two sides, a bottom and a back, the back having flaps movable from the closed position holding the pair of articles within the shell to an open position permitting the articles to be removed.

Thus, there has been outlined in summary form the more important features of the invention in order that the detailed description that follows may be better understood and in order that the present contribution to the art may be better appreciated. There are obvious additional features of the invention that will be described hereinafter and which will form the subject matter of the claims appended hereto. It is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing structures, methods and systems for carrying out the several purposes of the present invention. It is also to be understood that the abstract is neither intended to define the invention of the application, which is measured by the claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages and the specific objects obtained by its use, reference should be made to the accompanying drawings and descriptive matter in which like characters of reference designate like parts throughout the several views.

DETAILED DESCRIPTION OF THE PREFERRED EMBODIMENT

Figure 1:
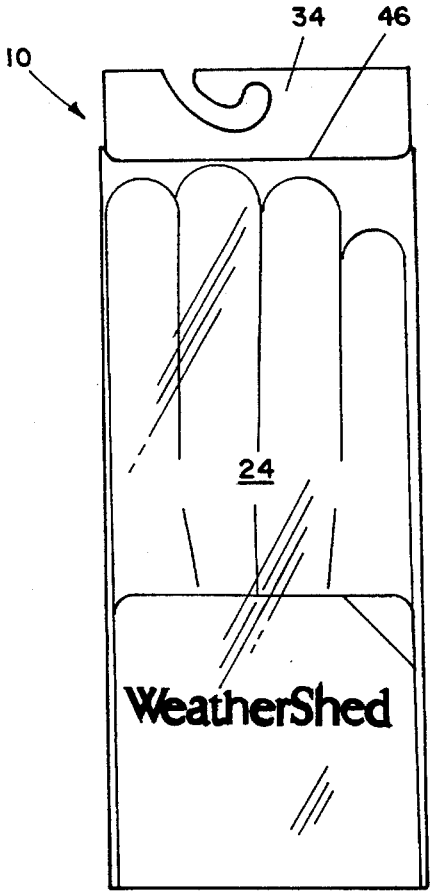
FIG. 1 is a side elevational view of the package for holding a pair of articles comprising the present invention.
Figure 2:
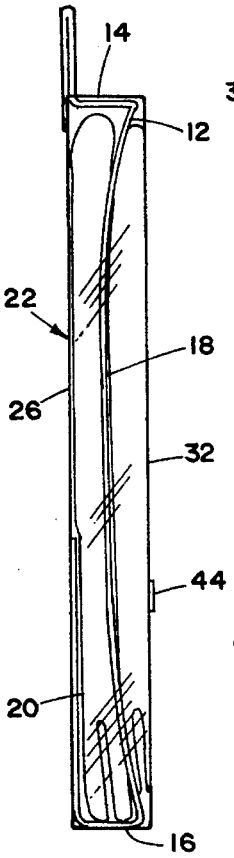
FIG. 2 is a side elevational view of the package of FIG. 1.

Referring now to the drawings and particularly to FIG. 1, a package for holding a pair of articles shown generally as 10 is made up of a foldable insert 12 that has a top portion 14, a bottom portion 16, a dividing portion 18 and a display portion 20 connected to bottom portion 16. A clear shell 22 houses the insert and article pair, in the example set forth in the drawings, gloves 24. Shell 22 has a front 26, two sides 28, a bottom 30 and a back 32. Back 32 has flaps 34,36 movable from a closed position holding gloves 24 within shell 22 to an open position permitting gloves 24 to be removed from shell 22.

Dividing portion 18 of insert 12 is positioned to separate the pair of gloves 24 from each other, preferably in alignment and in a palm-toward-palm relationship. Insert display portion 20 carries information indicia that can be read through shell front 26. It carries traditional information such as the appropriate trademark, product title and characteristics, and color code showing, for example, what lining is carried by the glove pair displayed.

Insert top portion 14 includes a hanging tab 34 in which is notched a recess 36 for cooperatively receiving a display peg if the gloves are to be displayed on a fixture.

Figure 3:
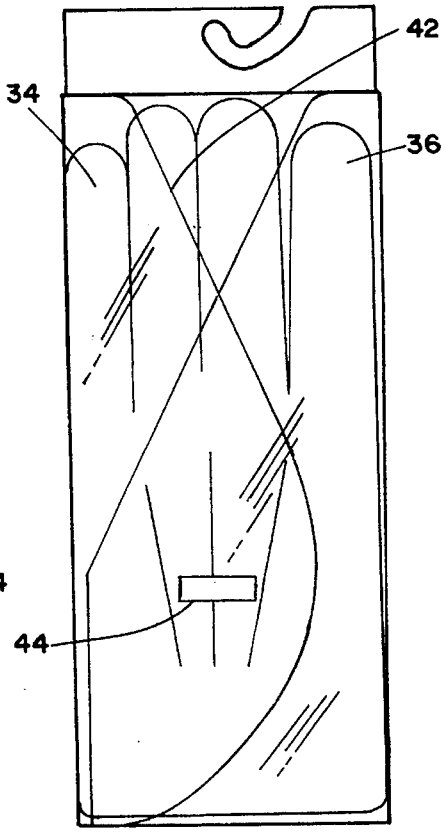
FIG. 3 is a rear elevational view of the package shown in FIGS. 1 and 2.
Figure 4:
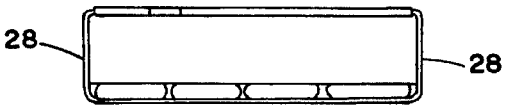
FIG. 4 is a plan view of the package shown in FIGS. 1, 2 and 3.
Figure 5:
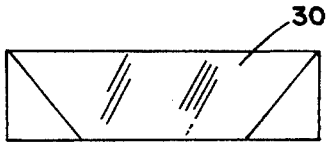
FIG. 5 is a bottom view of the package shown in FIGS. 1–4.

The shell back flaps 34,36 overlap each other when in the closed position (FIG. 3). One of the shell back flaps 34 has an arcuate free edge 42. Shell back flaps 34,36 carry appropriate means for fixedly securing the flaps in the closed position such as, for example, hook and loop material 44.

It has been found advantageous to include information indicia directly on the surface of one or both of back flaps 34,36 since printed material on the insert cannot be read because of the glove positioned adjacent back flaps 34,36 and over insert dividing portion 18.

Shell front 26 has an upper edge 46 contiguous with foldable insert top portion 14, both of which are shaped to include a hookable slot adjacent and similar to the hookable slot of top portion 14. Foldable insert top portion 14 is preferably double folded and adjacent to shell front upper edge 46.

The present invention may be embodied in other specific forms without departing from the spirit or essential attributes thereof and, accordingly, reference should be made to the appended claims, rather than to the foregoing specification, as indicating the scope of the invention.

What is claimed is:

1. A package for holding a pair of articles comprising: a foldable insert having a top portion, a bottom portion, a dividing portion connecting the top and bottom portions, and a display flap associated with the bottom portion; and a clear shell housing the insert and pair of articles, the shell having a front, two sides, a bottom and a back, the back having flaps moveable from a closed position holding the pair of articles within the shell to an open position permitting the articles to be removed from the shell, wherein the shell back has a first flap movably secured to one shell side and a second flap movably secured to the other shell side so that the first and second flaps overlap each other when in the closed position.

2. The claim as claimed in claim 1 wherein the insert dividing portion is positioned to separate the pair of articles from each other.

3. The claim as claimed in claim 1 wherein the insert display portion has informational indicia positioned thereon.

4. The package as claimed in claim 1 wherein the insert top portion includes hanging means.

5. The package as claimed in claim 1 wherein the clear shell back flaps overlap each other.

6. The package as claimed in claim 1 wherein the clear shell flap has means for fixably securing the flap in the closed position.

7. The package as claimed in claim 1 wherein at least one flap has informational indicia thereon.

8. The package as claimed in claim 1 wherein at least one of the shell back flaps has an arcuate free edge.

9. The package as claimed in claim 2 wherein the insert display portion has informational indicia positioned thereon.

10. The package as claimed in claim 2 wherein the insert top portion includes hanging means.

11. The package as claimed in claim 2 wherein the clear shell back flaps overlap each other.

12. The package as claimed in claim 2 wherein the clear shell flaps have means for fixedly securing the flaps in the closed position.

13. The package as claimed in claim 2 wherein at least one of the shell back flaps has an arcuate free edge.

14. The package as claimed in claim 9 wherein the insert top portion includes hanging means.

15. The package as claimed in claim 14 wherein at least one of the shell back flaps has an arcuate free edge.

16. The package as claimed in claim 15 wherein the fixedly securing means includes hook and loop materials.

17. The package as claimed in claim 16 wherein the top portion hanging means includes a hookable slot formed therein.

18. The package as claimed in claim 17 wherein the shell front has an upper edge contiguous with the foldable insert top portion and shaped to include a hookable slot adjacent and similar to the hookable slot of the top portion.

19. The package as claimed in claim 18 wherein the foldable insert top portion is double folded and adjacent to the shell front upper edge.

20. The package as claimed in claim 20 wherein the pair of articles are each glove having a palm and a back.

21. The package as claimed in claim 20 wherein the pair of gloves are held in a palm toward palm relationship.

* * * * *